US006657374B1

(12) United States Patent
Nagasawa et al.

(10) Patent No.: US 6,657,374 B1
(45) Date of Patent: Dec. 2, 2003

(54) CATHODE RAY TUBE

(75) Inventors: Kazushi Nagasawa, Tokyo (JP); Tesshin Yazu, Tokyo (JP); Hideya Ito, Tokyo (JP); Takashi Sugahara, Tokyo (JP); Hiroo Sakamoto, Tokyo (JP); Shiro Takada, Tokyo (JP); Junko Itoh, Tokyo (JP); Masayuki Miyazaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 364 days.

(21) Appl. No.: 09/584,858

(22) Filed: Jun. 1, 2000

(30) Foreign Application Priority Data

Sep. 13, 1999 (JP) ..... P. 11-258822

(51) Int. Cl.[7] ..... H01J 31/00

(52) U.S. Cl. ..... 313/477 R; 220/2.3 A; 220/2.1 A

(58) Field of Search ..... 313/477 R; 220/2.3 A, 220/2.1 A

(56) References Cited

U.S. PATENT DOCUMENTS 5,751,103 A * 5/1998 Opresko et al. ..... 313/477 R
6,208,067 B1 * 3/2001 Nakagawa et al. ..... 313/477 R
6,323,591 B1 * 11/2001 Oosterhout et al. ..... 313/477 R

FOREIGN PATENT DOCUMENTS

| | | | |
|---|---|---|---|
| CN | 1227666 A | 9/1999 | |
| JP | 11353343 | 12/1999 | ..... H01J/9/24 |
| KR | 1999-027071 | 4/1999 | ..... H01J/29/02 |
| WO | WO9807174 | 2/1998 | ..... H01J/29/86 |
| WO | WO9946795 | 9/1999 | ..... H01J/29/86 |

* cited by examiner

*Primary Examiner*—Nimeshkumar D. Patel
*Assistant Examiner*—Mariceli Santiago
(74) *Attorney, Agent, or Firm*—Birch, Stewart, Kolasch & Birch, LLP

(57) ABSTRACT

A cathode ray tube including a portion whose thickness becomes $$(2.78+0.0038\times D)\leqq t1\leqq(3.7+0.0038\times D)[\mathrm{mm}]$$

where D is a diagonal axis length [mm] between rectangular corner portions of an effective screen of a panel, and t1 is a thickness [mm] at positions which occupy 75% of a length of a body portion extending from a sealing surface of the body portion to a yoke portion along a tube axis direction.

13 Claims, 6 Drawing Sheets

COMPARISON OF SECTIONAL SHAPES OF GLASS BULBS
( EXAMPLE : MINOR AXIS SECTIONAL SHAPES OF TUBE SIZE OF D=410mm )

CATHODE RAY TUBE

BACKGROUND OF THE INVENTION

1. Field of the Invention

The present invention relates to a cathode ray tube having a lightweight funnel and a lightweight panel.

2. Description of the Related Art

A schematic appearance of a cathode ray tube is shown in

FIG. 6. In FIG. 6, D (mm) shows a diagonal axis length which is an effective dimension of a diagonal axis defined in EIAJ ED-2136A of the Standard of Electronic Industries Association of Japan.

FIG. 7 is a view showing a method of setting a diagonal axis length D of the cathode ray tube. In FIG. 7, a method 1 and a method 2 are shown. The method 1 can provide an effective shape (W, H, D: effective lengths of a major axis, a minor axis, and a diagonal axis shown in FIG. 6 respectively) by adding a 30-degree length of an blend R of an inner wall surface to the center position of the blend R of the inner wall surface, while using an R shape of a corner portion and a center position of the R shape of the panel inner wall surface (IL, IS, ID: center positions of the blend R of the panel inner wall surface in respective sectional shapes along the major axis, the minor axis, and the diagonal axis shown in FIG. 6 respectively). The method 2 can provide an effective diameter by using a contact point P of an inner curved surface Z=f(x,y) and the blend R, as shown in the right side in FIG. 7.

A sectional shape taken along an A–A' line in FIG. 6 is shown in FIG. 8. In FIG. 8, 1*a* denotes a panel; 11, a face surface which is formed on the panel 1*a* and has a substantially square outer shape and on which the image is displayed; 12, a blend R portion of an outer wall surface; 13, a skirt portion which extends substantially vertically from all areas of an outer peripheral portion of the face surface 11 to the face surface 11; 1*b*, a funnel which has a funnel shape whose outer shape of a widest open portion of the funnel shape has the same outer shape as the skirt portion 13 of the panel 1*a*; 14, a sealing portion for connecting the panel 1*a* and the funnel 1*b*; 121, an F0 point which is located in the neighborhood of a joint between the blend R portion 12 and the face surface 11; 122, an F1 point which is located in the neighborhood of a joint between the blend R portion 12 and the skirt portion 13; 18, a neck portion which is a part of the funnel 1*b* and into which the electron gun is installed; 17, a yoke portion which is a part of the funnel 1*b* and onto which a deflection yoke for deflecting electron beams is fitted; 15, a body portion which is a part of the funnel 1*b* as shown in FIG. 8 and extends to the sealing portion 14 connected to the panel; and 16, a TOP OF ROUND which is an inflection point on a boundary line between the yoke portion 17 and the body portion 15 and is located at a position remote from a yoke reference line by 40 to 50 mm in the sealing portion direction. In this case, the yoke reference line is a reference line in a tube axis of the funnel, which is set forth in EIAJ ED-2134B.

As for the shape of the funnel 1*b*, respective dimensions of the sectional shape of the funnel 1*b* shown in FIG. 9 are given in Table 1 as an example.

TABLE 1

| Funnel Outer Shape | | [mm] | | |
|---|---|---|---|---|
| Diagonal axis length | D | 410 mm | 460 mm | 510 mm |
| Minor axis outer length | L1 | 147.09 | 164.14 | 184.44 |
| Major axis outer length | L2 | 182.44 | 205.74 | 227.24 |
| Diagonal axis outer length | L3 | 220.64 | 246.49 | 274.54 |
| Sealing portion to Reference line | L4 | 154.1 | 183.7 | 198.7 |
| Reference line to Neck portion | L5 | 43.4 | 43.4 | 43.4 |
| Reference line to Top of Round | L6 | 43.4 | 45.03 | 45.03 |
| Total length (Reference value) | L7 | 324.5 | 354.1 | 369.1 |

The outer shape of the funnel 1*b* shown in FIG. 9 is connected smoothly from the neck portion 18, which is formed as a pipe shape of less than ϕ40 mm in parallel with the tube axis direction, to the cone-shaped yoke portion 17, to which the deflection yoke is fitted and which is formed smoothly by using several R-shapes, and then connected to the sealing portion 14 via the TOP OF ROUND 16.

Normally, if the glass bulb consisting of the panel 1*a* and the funnel 1*b* is designed, a maximum tensile vacuum stress which is generated when an inside of the glass bulb is made vacuous is decided from a viewpoint of reliability, especially a viewpoint of the delayed fracture performance, and then a thickness is decided by using the stress as a threshold value. In addition, portions at which the vacuum stress is generated to cause the reduction of the reliability are located in the neighborhood of the blend R portion 12 of the face surface 11 of the panel, and in many cases such vacuum stress is generated mainly on the F0 point 121 or the F1 point 122 which is located within a width of 20 mm from both end positions of the blend R.

First, thicknesses at the F0 point 121 and the F1 point 122 are decided in view of the maximum vacuum stress. Then, a thickness distribution of the skirt portion 13 is decided such that the crack of the glass, etc. are not generated in the heating process step contained in manufacturing steps of the glass bulb. Accordingly, thicknesses up to the sealing portion 14 are decided, whereby the thickness design of the panel 1*a* can be completed.

Then, a thickness of the funnel 1*b* is decided based on the thickness of the sealing portion 14, whereby the shape design of the funnel 1*b* can be completed. That is, thicknesses of the body portion 15 and the yoke portion 17 are decided according to the thickness of the sealing portion 14 to be connected smoothly to the neck portion 18.

For example, as for the aperture grille type cathode ray tube which has the panel 1*a* whose diagonal axis length D is 410 mm and to which a physically reinforcing layer is applied, and in which the maximum value of the stress generated on a surface of the panel 1*a* when the inside of the glass bulb is made vacuous is less than 8.85 MPa, and in which an outer shape R of the face surface 11 is about more than R 30000 mm, the center thickness of the panel 1*a* is set to about 12 mm, the width of the sealing portion 14 is set to about 9 mm, and the thickness of the body portion 15 is set to about 5.4 mm at the lowest minimum in the range from the B–B' sectional shape to the C–C' sectional shape of the body portion 15 shown in FIG. 8.

In this case, the B–B' sectional shape is located at a position which is a half of the funnel body portion in the height direction. Also, a sectional shape which is located just in the middle of the B–B' sectional shape and the TOP OF ROUND to divide the height into two parts is set as the C–C' sectional shape.

Thickness data of the glass bulb shape every diagonal axis length D are set forth in Table 2.

TABLE 2

| (D) | Example 1 (410 mm) | Example 2 (460 mm) | Example 3 (510 mm) |
|---|---|---|---|
| Center thickness | 12.0 mm | 13.0 mm | 14.0 mm |
| Sealing surface thickness | 9.0 mm | 9.0 mm | 9.2 mm |
| Body portion center thickness | 5.4 mm | 5.5 mm | 5.5 mm |

Here, the center thickness means a center thickness of the panel 1*a*, the sealing surface thickness means a thickness of the sealing portion 14, and the body portion center thickness means a minimum value of the thickness (here, the thickness on the minor axis) in the range from the B–B' sectional shape to the C–C' sectional shape (positions corresponding to 50 to 75% of the length of the funnel body portion 15 along the tube axis direction) of the body portion 15 shown in FIG. 8.

In the structure of the cathode ray tube in the related art, since the design is carried out in light of several points such as the blend R portion 12, etc., such design depends largely upon the experience of the designer and thus the cathode ray tube has the unnecessary thickness which is naturally unnecessary. In particular, the cathode ray tube having a flat panel face tends to increase the thickness, and thus a weight of the cathode ray tube becomes heavy.

SUMMARY OF THE INVENTION

The present invention has been made to overcome the above subjects, and it is an object of the present invention to provide a lightweight cathode ray tube by detecting an optimal thickness of a funnel portion.

In order to achieve the above object, according to the present invention, there is provided a cathode ray tube comprising: a panel having a face surface whose outer shape is a substantial rectangle and a skirt portion which extends substantially vertically from all areas of an outer peripheral portion of the face surface to the face surface; a funnel which has a funnel shape whose outer shape of a widest open portion of the funnel shape has a same outer shape as the skirt portion of the panel; and a sealing portion for connecting the panel and the funnel, wherein the funnel comprises a body portion having a sealing surface which is connected to the sealing portion, a yoke portion connected to the body portion, and a neck portion connected to the yoke portion, and wherein the cathode ray tube includes a portion whose thickness becomes $$(2.78+0.0038\times D)\leqq t1\leqq(3.7+0.0038\times D)[\text{mm}]$$

where D is a diagonal axis length [mm] between rectangular corner portions of an effective screen of the panel, and t1 is a thickness [mm] at positions which occupy 75% of a length of the body portion extending from the sealing surface of the body portion to the yoke portion along a tube axis direction.

DETAILED DESCRIPTION OF THE PREFERRED EMBODIMENT

In order to obtain a cathode ray tube according to the present invention, the design approach which has been disclosed in Japanese Patent Application No. Hei. 10-159674 is employed. Then, the design approach will be described hereinbelow.

This design approach is an optimization analytic approach in which the unique improvement is added to the existing genetic algorithm (abbreviated as "GA" hereinafter). This design approach executes the analysis by using thicknesses of the glass bulb as parameters to obtain the glass bulb which can have optimal thicknesses.

Figure 1:
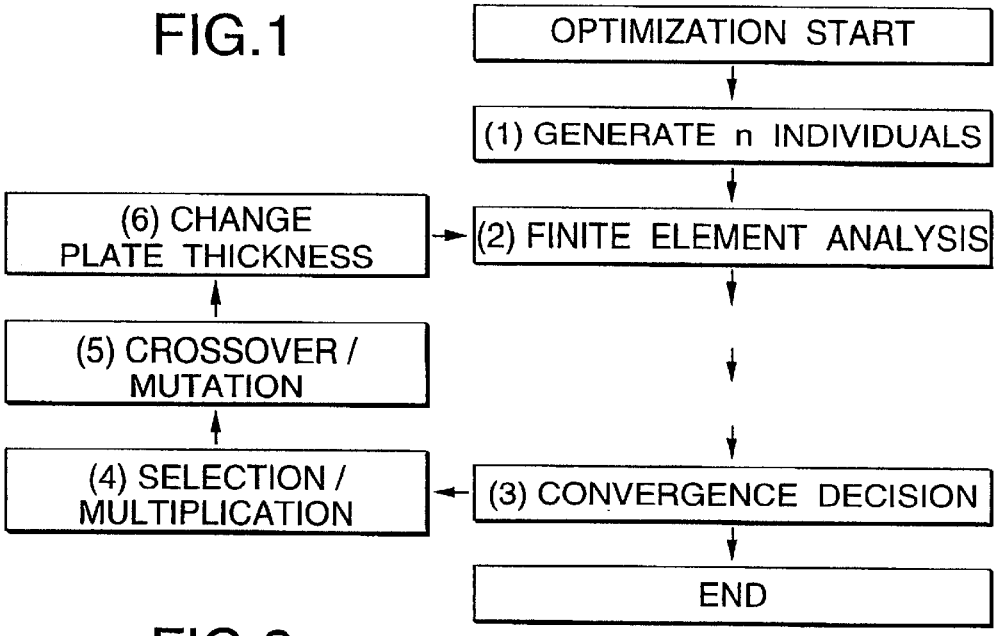
FIG. 1 is a flowchart showing an optimally analyzing approach according to the present invention.

FIG. 1 is a flowchart showing an optimally analyzing approach according to the present invention. In FIG. 1, (1) Initial plate thicknesses (thicknesses) of respective elements of the analysis model for n individuals (referred to as "individuals" hereinafter) are decided based on the random numbers. The n individuals are analyzed by the FEM to calculate the maximum stress. Also, four parameters of $\alpha$, $\beta$, $\gamma$, $\delta$ are defined every individual, and 0.0 to 1.0 values of respective parameters are expressed 8-bit genes. That is, the expression of 8-bit genes signifies that the values of respective parameters are divided equally into 256 equal parts in the domain and then expressed by 8-place binary digits.

(2) The maximum stress and the weight are calculated by FEM-analyzing respective individuals to calculate a degree of adaptation based on Equation (c) described later.

(3) The convergence decision is performed.

(4) The individuals (models) with the low degree of adaptation are selected (rejected) and the individuals with the high degree of adaptation are multiplied (the number of models is increased). Thus, life groups are evolved.

(5) The values of parameters of $\alpha$, $\beta$, $\gamma$, $\delta$ are changed. As a method of changing, neighborhood values of the parameters some two individuals (models) may be selected (this is referred to as the crossing), or completely different values may be adopted by using the random number (this is referred to as the mutation).

(6) The plate thickness (thickness) is changed based on Equation (a) described in the following.

$$th_i^{g+1} = \sqrt{\frac{\sigma_j}{\sigma_o}} \times \frac{1}{\beta} \times th_i^g \left(\text{if } \frac{\sigma_j}{\sigma_o} < \alpha\right)$$

$$th_i^{g+1} = \sqrt{\frac{\sigma_j}{\sigma_o}} \times \frac{1}{\delta} \times th_i^g \left(\text{if } \frac{\sigma_j}{\sigma_o} < \gamma\right)$$

Equation (a)

$$P = \sum_{i=1}^{n} \begin{Bmatrix} \left(\frac{\sigma_j}{\sigma_o} - 1\right) & \left(\text{if } \frac{\sigma_j}{\sigma_o} > 1.0\right) \\ 0 & \left(\text{if } \frac{\sigma_j}{\sigma_o} < 1.0\right) \end{Bmatrix}$$

Equation (b)

$$Fit = 1 - \frac{W}{W_o} - C \times P$$

Equation (c)

$$C = g \times g / G$$

Equation (d)

In other words, if a stress ratio $\sigma_j/\sigma_a$ is smaller than $\alpha$, the plate thickness (thickness) is changed as indicated by the first equation of Equation (a). Also, if the stress ratio $\sigma_j/\sigma_a$ is larger than $\gamma$, the plate thickness (thickness) is changed as indicated by the second equation of Equation (a). In this case, the case where the bending stress is dominant is considered, $(\sigma_j/\sigma_a)^{1/2}$ is employed as the plate thickness changing parameter.

Here, $\beta$ and $\delta$ are parameters associated with increase and decrease of the plate thickness. In Equation (a), $th_g$, is the plate thickness of the element j in the generation g, $\sigma_j$ is the maximum stress (absolute value) of the element j, and $\sigma_a$ is the allowable stress of the member.

Also, in the case of the constrained optimization problem, there has been proposed such an approach that, when the constraint is not satisfied, the penalty term is added to the evaluation value to lower a degree of adaptation. However, there is such a possibility that the resolution to satisfy the constraint cannot be obtained if a weight coefficient of the penalty term is small, but it is difficult to obtain the wide area optimal solution if the weight coefficient is large. Hence, in the above Application, an solution searching efficiency can be improved by setting the penalty term as a function of the number of generation.

As the result of the FEM analysis, if the element stress is in excess of the allowable stress, the penalty value P is decided against the excess stress, as indicated by Equation (b), and also the penalty term in which P is multiplied by C is added to the non-dimensional weight in the degree of adaptation, as indicated by Equation (c). Where $C \approx 0$ is set in the stage that the number of generation is small, as indicated by Equation (d), and the individuals which cannot satisfy the constraint are ready to be selected by increasing C with the increase of the number of generation to thus increase the penalty.

In Equation (c), Fit denotes the degree of adaptation; W, the weight; Wo, a reference weight; P, the penalty value; C, the weight constant; $\sigma_j$, the element stress of the element j; and g, the number of generation. Also, in the above Application, the number of generation is used as the calculation closing condition, G denotes the final number of generation, and n denotes the number of element.

In this case, as characteristic values, the elastic modulus E (GPa)=71.5, the Poisson's ratio $\nu$=0.21, the density r (kg/mm$^3$)=$2.5\times10^{-6}$ are applied to the panel 1*a*. Also, the elastic modulus E (GPa)=69.2, the Poisson's ratio $\nu$=0.19, the density r (kg/mm$^3$)=$3.0\times10^{-6}$ are applied to the funnel 1*b*.

Embodiment 1

Figure 2:
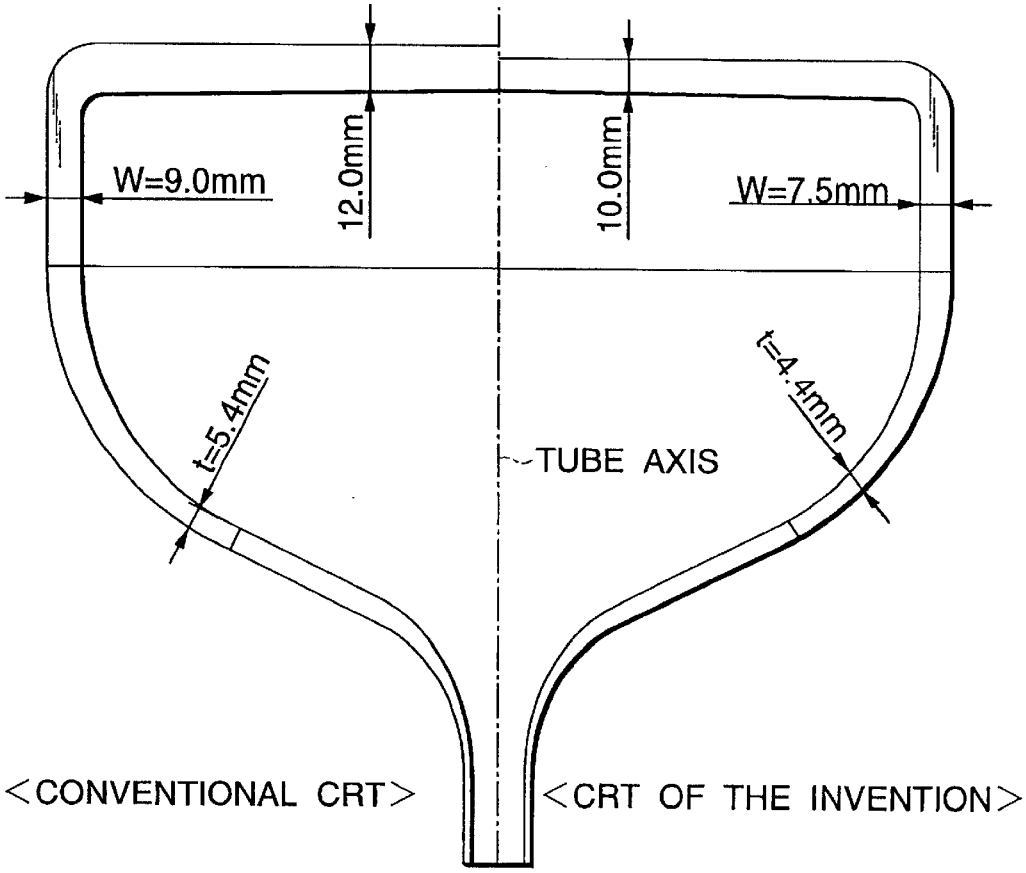
FIG. 2 is a view showing sectional shapes of a conventional glass bulb and a glass bulb according to the present invention for the sake of comparison.

As a cathode ray tube according to the present invention, if such a cathode ray tube is employed that the glass which has a physically reinforcing layer thereon is used, the maximum value of the stress generated on the panel outer surface when the inside of the bulb is made vacuous is set to 10.2 MPa, an aspect ratio of the panel face surface is set as 3:4, the panel face surface has an almost flat shape having about R30000 mm or more, and the color selection electrode is of the aperture grille type, for example, is employed, the thickness of the body portion 15 can be thinned up to about 4.4 mm along the minor axis, and accordingly the thickness of the sealing portion 14 can be thinned up to about 7.5 mm, and the center thickness of the face portion of the panel 1*a* can be thinned up to about 10 mm when a diagonal axis length D of 410 mm, for example, is selected. For the sake of comparison, sectional shapes of the conventional glass bulb and the glass bulb according to the present invention, both have the diagonal axis length D of 410 mm, are shown in FIG. 2.

Figure 8:
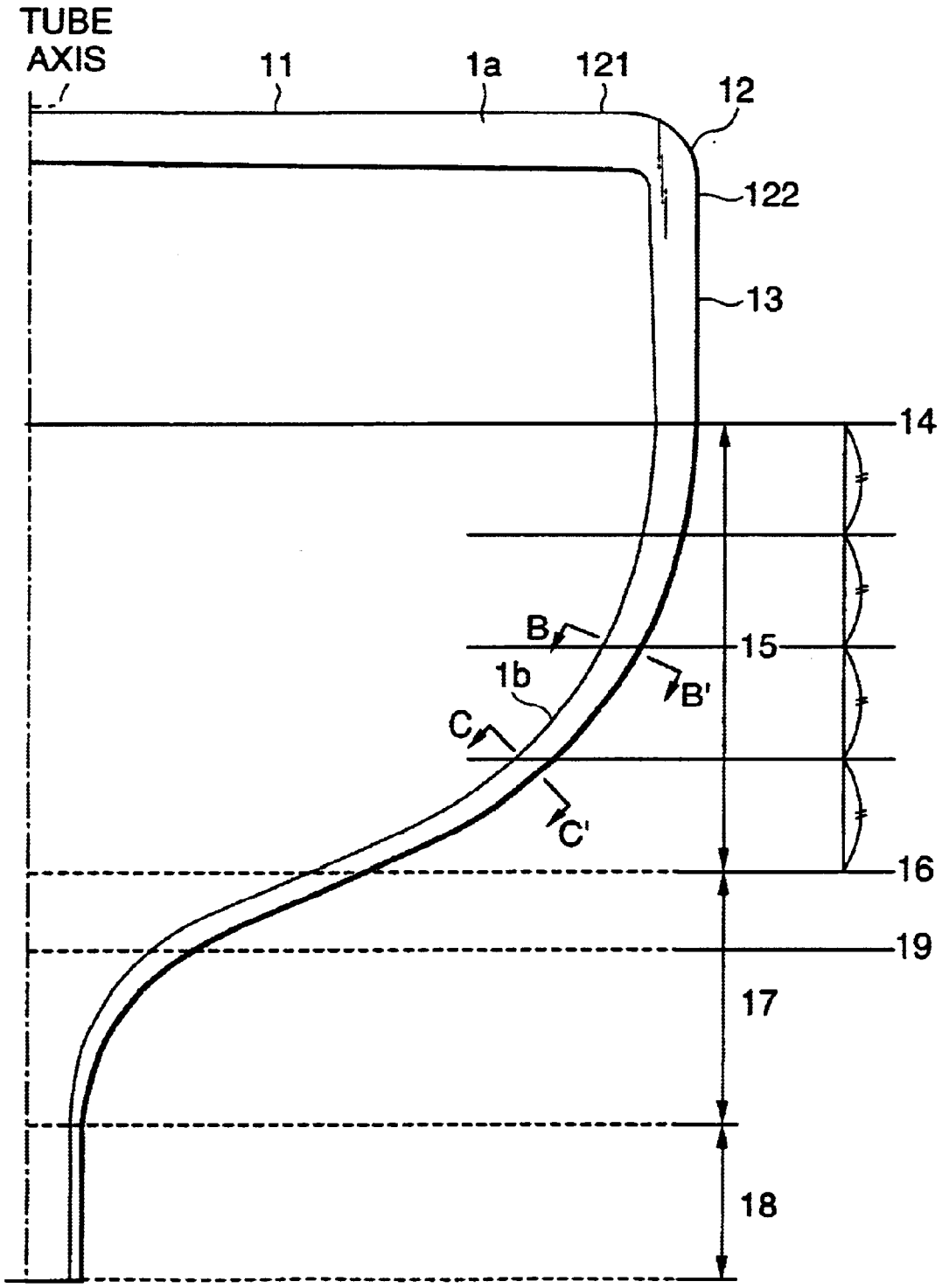
FIG.8 PRIOR ART
FIG. 8 is a sectional view showing a sectional shape of the cathode ray tube taken along an A–A' line in FIG. 6.
Figure 9:
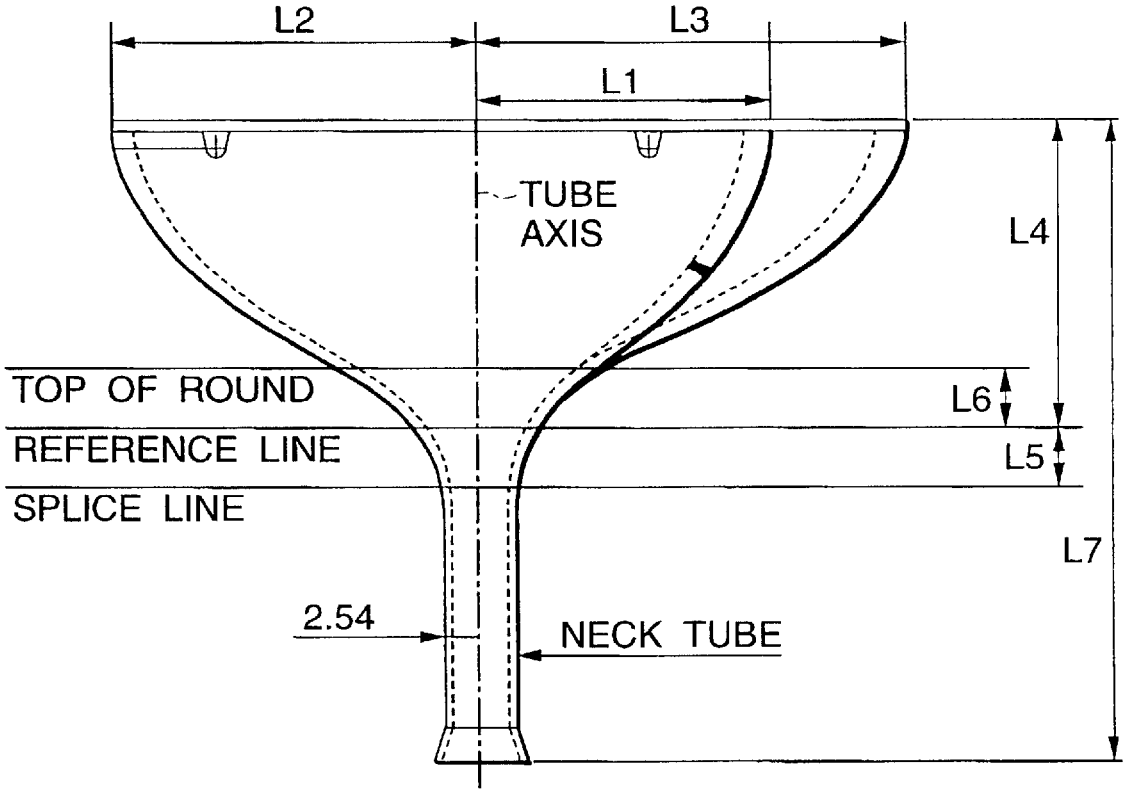
FIG. 9 is a sectional view showing a shape of the funnel portion of the cathode ray tube.

Since a width of the sealing portion 14 on the funnel 1*b* side must be given appropriately with respect to a width of the sealing portion 14 on the panel 1*a* side, a thickness in the vicinity of the sealing portion 14 of the funnel 1*b* cannot be thinned independently with the thickness of the sealing portion 14 on the panel 1*a*. For example, even if the thickness of the body portion 15 is optimal at 4.4 mm, the thickness in the neighborhood of the sealing portion 14 of the body portion 15 cannot be set immediately to 4.4 mm since a smooth distribution of the thickness from 7.5 mm as the thickness of the sealing portion 14 of the panel 1*a* must be attained. However, for example, reduction in the thickness can be achieved at locations from the B–B' sectional shape to the C–C' sectional shape of the body of the funnel shown in FIG. 8.

Embodiment 2

As the cathode ray tube according to the present invention, results of the glass bulb shape are given in Table 3.

TABLE 3

| (D) | Example 1 (410 mm) | Example 2 (460 mm) | Example 3 (510 mm) |
|---|---|---|---|
| Center thickness | 10.0 mm | 11.0 mm | 12.0 mm |
| Sealing surface thickness | 7.5 mm | 8.0 mm | 8.5 mm |
| Body portion center thickness | 4.4 mm | 4.4 mm | 4.8 mm |

The body portion center thickness set forth in this example is a value on the minor axis. According to the above configuration, a lightweight cathode ray tube which is able to omit an amount of useless glass can be obtained.

Embodiment 3

Respective dimensions of the conventional cathode ray tubes and the cathode ray tubes according to embodiments of the present invention at this time are given in Table 4. Numeral values (☆ mark) in Table 4 correspond to the embodiments at this time.

TABLE 4

[mm]

| Diagonal axis length D | Minor axis thickness ts | Major axis thickness tl | Diagonal axis thickness td |
|---|---|---|---|
| 410 | 6.40 | 6.70 | 6.90 |
| 410 | 5.45 | 5.98 | 6.60 |
| ☆410 | 4.40 | 4.65 | 4.90 |
| 410 | 5.50 | 5.87 | 6.50 |
| 460 | 5.50 | 6.10 | 6.60 |
| ☆460 | 4.40 | 4.70 | 4.90 |
| 500 | 5.88 | 6.50 | 6.75 |
| 500 | 5.88 | 6.50 | 6.75 |
| 510 | 5.80 | 6.13 | 6.45 |
| ☆510 | 4.78 | 5.00 | 5.56 |

Figure 3:
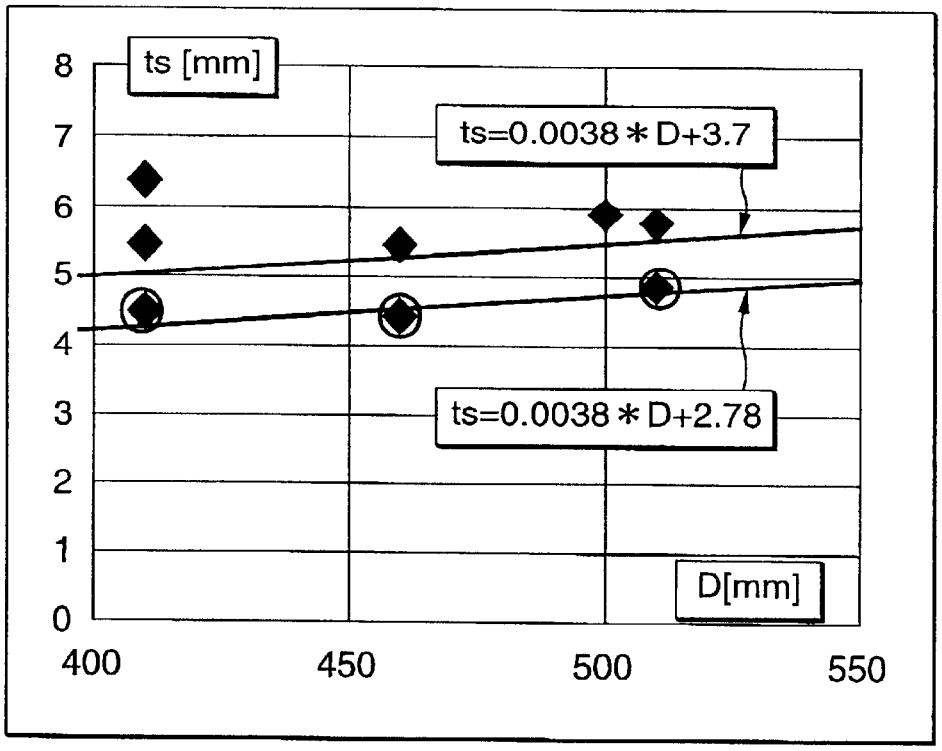
FIG. 3 is a graph showing actually measured values of a thickness of a funnel body portion in a C–C' sectional shape of the cathode ray tube in FIG. 8.

FIG. 3 shows measured values of the thickness of the funnel body portion as a graph by plotting Table 4. Where an abscissa denotes the diagonal axis length D of the effective screen of the panel, and an ordinate denotes a smallest thickness ts of the thickness t1 in the C–C' sectional shape of the body portion on the minor axis. In this case, FIG. 3 is depicted to confirm a level to which the cathode ray tube according to the present invention at this time can be improved rather than the conventional cathode ray tube.

In FIG. 3, points encircled with a circle indicate embodiments according to the present invention at this time, and other points indicate conventional examples. Out of two straight lines in the graph, a lower straight line is obtained by a linear approximation based on the method of least squares in order to get a relationship between the thickness ts of the body portion 15 on the minor axis of the cathode ray tube according to the present invention at this time and the diagonal axis length D. Since it may be supposed that a lower limit value of the thickness is changed according to the diagonal axis length D and thus the minimum thickness value becomes thick as the diagonal axis length D is increased, this relationship can be approximated by a right-upward inclined straight line.

An approximate expression ts of the lower straight line can be given as $$ts=2.78+0.0038\times D[\text{mm}].$$

It is possible to reduce the thickness ts into this value.

While, an upper straight line in FIG. 3 can be depicted by lifting the lower straight line up to a level of the conventional cathode ray tube while keeping a gradient 0.0038 of the lower straight line. The upper straight line has an approximate expression ts $$ts=3.7+0.0038\times D[\text{mm}].$$

This is because, if predetermined constraints are given, the thickness of the funnel body portion has a linear relationship, which has the same gradient 0.0038 as the above approximate expression, relative to the bulb size.

Here, ts is the thickness on the minor axis to provide the thinnest portion of t1. Since the lower limit value of ts means a lower limit value of the thinnest portion of t1, such lower limit value may be said in other words as a lower limit value of t1.

Accordingly, such a shape can be obtained that contains a portion whose thickness t1 becomes $$(2.78+0.0038\times D)\leqq t\mathbf{1}\leqq(3.7+0.0038\times D)[\text{mm}]$$

at positions which occupy 75% of the length of the body portion 15 extending from the sealing surface of the body portion 15 to the yoke portion 17 along the tube axis direction.

In addition, Table 5 indicates a relationship between the minimum value t2 [mm] of the thickness of the body portion, which extends from the B–B' sectional shape to the C–C' sectional shape, and the diagonal axis length D of the effective screen.

TABLE 5

[mm]

| Diagonal axis length D | Minimum thickness t2 | Maximum thickness | Difference |
|---|---|---|---|
| 410 | 6.40 | 7.10 | 0.70 |
| 410 | 5.40 | 6.80 | 1.40 |
| ☆410 | 4.40 | 5.10 | 0.70 |
| 410 | 5.50 | 6.70 | 1.20 |
| 460 | 5.50 | 6.80 | 1.30 |
| ☆460 | 4.40 | 5.90 | 1.50 |
| 500 | 5.80 | 6.80 | 1.00 |
| 500 | 5.80 | 6.80 | 1.00 |
| 510 | 5.50 | 6.60 | 1.10 |
| ☆510 | 4.78 | 5.10 | 0.32 |

Figure 4:
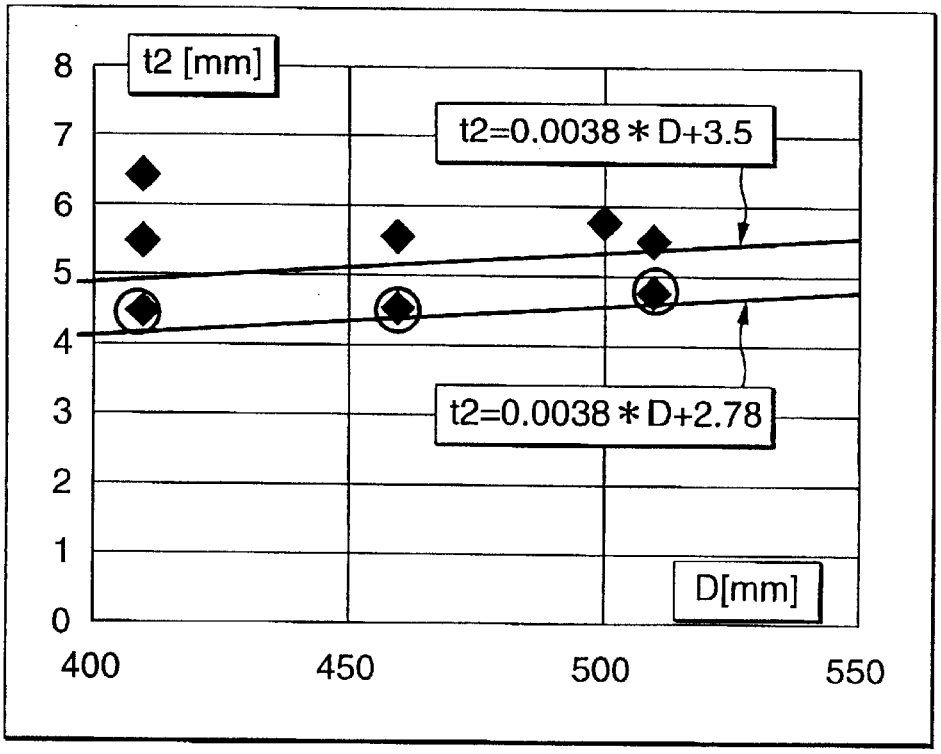
FIG. 4 is a graph showing minimum thickness values of the funnel body portion in a range from a B–B' sectional shape to the C–C' sectional shape of the cathode ray tube in FIG. 8.

FIG. 4 shows measured minimum thickness values of the funnel body portion as a graph by plotting Table 5. Such a shape can be obtained that contains a portion whose thickness t2 becomes $$(2.78+0.0038\times D)\leqq t\mathbf{2}\leqq(3.5+0.0038\times D)[\text{mm}]$$

in a range between the B–B' sectional shape and the C–C' sectional shape, i.e., at positions which occupy 50% to 75% of the length of the body portion 15 extending from the sealing portion 14 to the neck portion 18 along the tube axis direction.

Accordingly, the thickness of the body portion 15 can be reduced as a whole between the B–B' sectional shape and the C–C' sectional shape.

Embodiment 4

Table 6 indicates a sum of a thickness w of a shielding portion and the thickness ts of the funnel body portion relative to the diagonal axis length D of the effective screen of the panel, in the conventional cathode ray tube and the cathode ray tube according to the present invention.

TABLE 6

[mm]

| Diagonal axis length D | Minor axis thickness ts | Sealing portion thickness w | (ts + w) |
|---|---|---|---|
| 410 | 6.40 | 9.0 | 15.40 |
| 410 | 5.45 | 9.0 | 14.45 |
| ☆410 | 4.40 | 7.5 | 11.90 |
| 410 | 5.50 | 9.0 | 14.50 |
| 460 | 5.50 | 9.0 | 14.50 |
| ☆460 | 4.40 | 8.0 | 12.40 |
| 500 | 5.88 | 9.2 | 15.08 |
| 500 | 5.88 | 9.2 | 15.08 |
| 510 | 5.80 | 9.2 | 15.00 |
| ☆510 | 4.78 | 8.5 | 13.28 |

Figure 5:
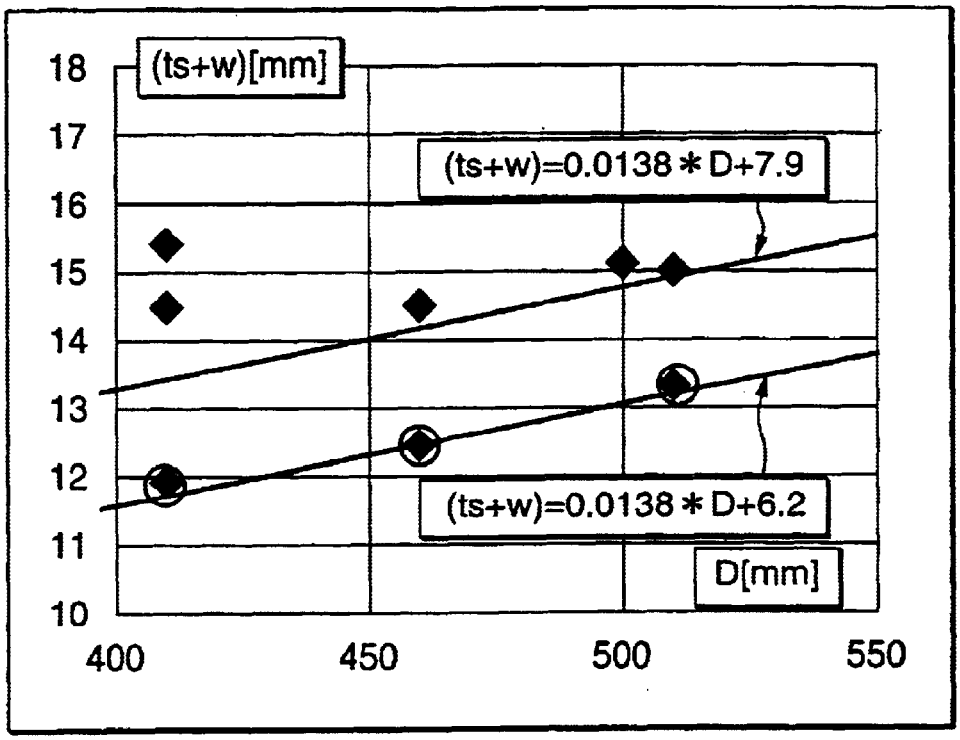
FIG. 5 is a graph showing a thickness ts of the funnel body portion and a thickness w of a sealing portion of the cathode ray tube for the sake of comparison.
Figure 6:
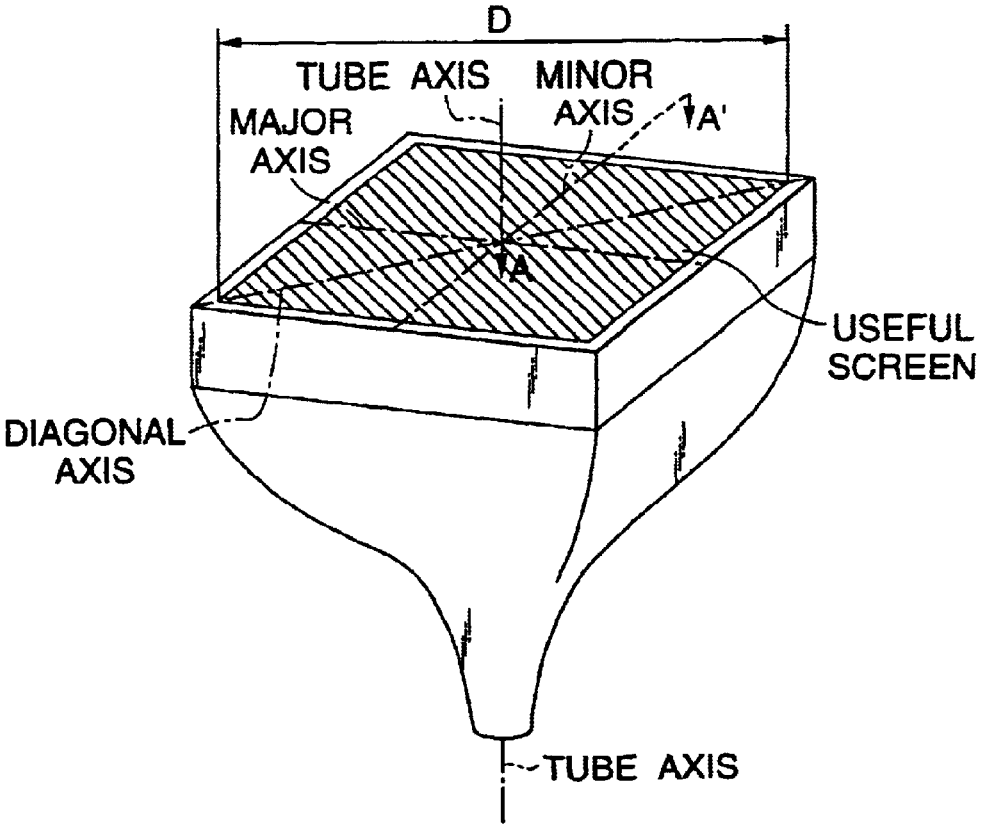
FIG.6 PRIOR ART
FIG. 6 is a schematic perspective view showing an appearance of the cathode ray tube.
Figure 7:
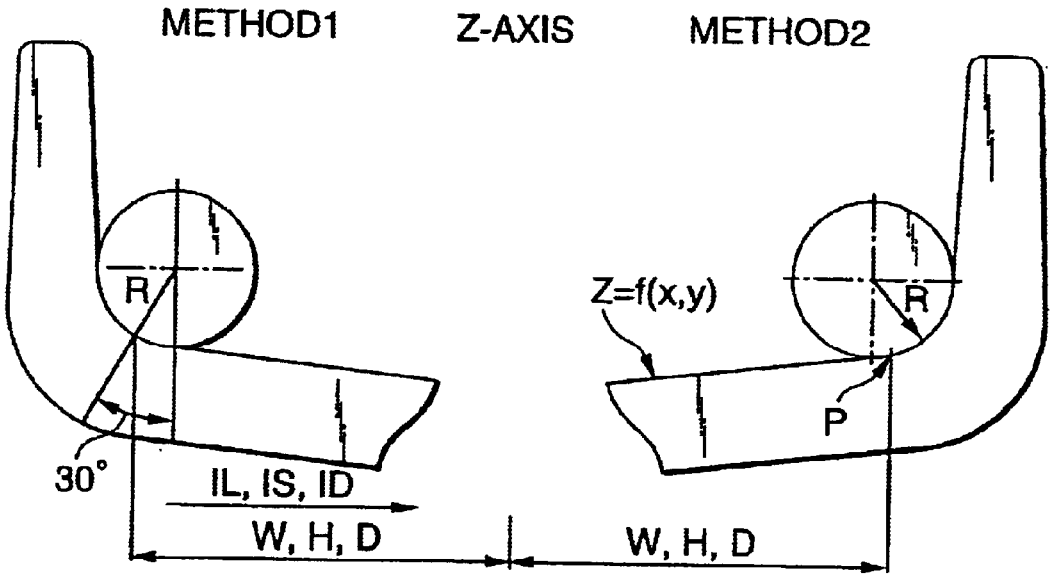
FIG.7 PRIOR ART
FIG. 7 is a view showing a method of setting a diagonal axis length D of the cathode ray tube.

FIG. 5 shows measured numerical values in Table 6 as a graph in the conventional cathode ray tube and the cathode ray tube according to the present invention, wherein an abscissa denotes the diagonal axis length D of the effective screen of the panel and an ordinate denotes the sum of the thickness w of the shielding portion and the smallest thickness ts of the thickness t1 of the funnel body portion on the minor axis. The points encircled with a circle indicate examples of the cathode ray tube according to the present invention at this time. If the sectional shape of the funnel portion extending from the sealing portion to the body portion is assumed as a trapezoid having an upper base and a lower base, the weight can become lighter as an area of the funnel is reduced more and more. Therefore, if a height from the sealing portion to the body portion thickness ts is assumed constant, the lightweight funnel can be obtained by reducing a value of (ts+w)

As for two straight lines in the graph in FIG. 5, a lower straight line is obtained by the linear approximation based on the method of least squares in order to get a correlation between the sum (ts+w) of the thickness ts of the body portion 15 and the thickness w of the sealing portion of the cathode ray tube according to the present invention at this time and the diagonal axis length D. Such approximated straight line can give the sum $$(ts+w)=(6.2+0.0138\times D)[\text{mm}]$$

under a limitation w≧ts≧4.4 [mm] in the method of manufacturing the panel glass and the funnel glass by the present press machine. Thus, it is possible to reduce the sum (ts+w) up to the above value.

Here, ts is a thickness on the minor axis to provide the thinnest portion of the thickness t1. Hence, since the lower limit value of ts means the lower limit value of the thinnest portion of t1, such lower limit value may be said in other words as the lower limit value of t1. Since the lower limit value of (t1+w) becomes (ts+w), (6.2+0.0138×D)≦(w+t1) can be derived within the range of w≧t1≧4.4. In this case, the upper straight line in the graph in FIG. 5 can be depicted by lifting the lower straight line up to a level of the conventional cathode ray tube while holding a gradient of the lower straight line.

As a result, a relationship of $$(6.2+0.0138\times D)\leqq(w+t1)\leqq(7.9+0.0138\times D)[\text{mm}]$$

where w≧t1≧4.4 can be derived.

Since the present invention is constructed as described above, it is possible to form the glass bulb of the cathode ray tube into a useful shape, and therefore the reduction in cost and the improvement in handling property can be achieved because of the reduction in weight of the glass bulb per se.

What is claimed is:

1. A cathode ray tube comprising:

a panel having a face surface whose outer shape is a substantial rectangle and a skirt portion which extends substantially vertically from all areas of an outer peripheral portion of the face surface to the face surface;

a funnel which has a funnel shape whose outer shape of a widest open portion of the funnel shape has a same outer shape as the skirt portion of the panel; and a sealing portion for connecting the panel and the funnel, wherein the funnel comprises a body portion having a sealing surface which is connected to the sealing portion, a yoke portion connected to the body portion, wherein a wall thickness of the yoke portion is substantially uniform, and a neck portion connected to the yoke portion, and wherein the cathode ray tube includes a portion whose thickness becomes $$(2.78+0.0038\times D)\leqq t1\leqq(3.7+0.0038\times D)(\text{mm}),$$

where D is a diagonal axis length (mm) between rectangular corner portions of an effective screen of the panel, and t1 is a thickness (mm) at positions which occupy 75% of a length of the body portion extending from the sealing surface of the body portion to the yoke portion along a tube axis direction.

2. The cathode ray tube according to claim 1, further including a portion whose thickness becomes $$(2.78+0.0038\times D)\leqq t2\leqq(3.5+0.0038\times D)(\text{mm}),$$

where t2 is a thickness (mm) at positions which occupy 50% to 75% of the length of the body portion extending from the sealing portion to the neck portion along the tube axis direction.

3. The cathode ray tube according to claim 1, further including a portion whose thickness becomes $$(6.2+0.0138\times D)\leqq(w+t1)\leqq(7.9+0.0138\times D)(\text{mm}),$$

where w is a thickness (mm) of the sealing portion and w≧t1≧4.4 (mm).

4. The cathode ray tube according to claim 1, wherein D is 410 mm, a center thickness of the panel is 10.0 mm, the sealing surface thickness is 7.5 mm, and a body portion center thickness is 4.4 mm.

5. The cathode ray tube according to claim 1, wherein D is 460 mm, a center thickness of the panel is 11.0 mm, the sealing surface thickness is 8.0 mm, and a body portion center thickness is 4.4 mm.

6. The cathode ray tube according to claim 1, wherein D is 510 mm, a center thickness of the panel is 12.0 mm, the sealing surface thickness is 8.5 mm, and a body portion center thickness is 4.8 mm.

7. A method of forming a cathode ray tube comprising:

forming a panel having a face surface whose outer shape is a substantial rectangle and a skirt portion which extends substantially vertically from all areas of an outer peripheral portion of the face surface to the face surface;

forming a funnel which has a funnel shape whose outer shape of a widest open portion of the funnel shape has a same outer shape as the skirt portion of the panel; and connecting the panel and the funnel at a sealing portion, wherein the funnel comprises a body portion having a sealing surface which is connected to the sealing portion, a yoke portion connected to the body portion, wherein a wall thickness of the yoke portion is substantially uniform, and a neck portion connected to the yoke portion, and wherein the cathode ray tube includes a portion whose thickness becomes $$(2.78+0.0038\times D)\leqq t1\leqq(3.7+0.0038\times D)(\text{mm}),$$

where D is a diagonal axis length (mm) between rectangular corner portions of an effective screen of the panel, and t1 is a thickness (mm) at positions which occupy 75% of a length of the body portion extending from the sealing surface of the body portion to the yoke portion along a tube axis direction.

8. The method according to claim 7, further including a portion whose thickness becomes $$(2.78+0.0038\times D)\leqq t2\leqq(3.5+0.0038\times D)(\text{mm}),$$

where t2 is a thickness (mm) at positions which occupy 50% to 75% of the length of the body portion extending from the sealing portion to the neck portion along the tube axis direction.

9. The method according to claim 7, further including a portion whose thickness becomes $$(6.2+0.0138\times D)\leqq(w+t1)\leqq(7.9+0.0138\times D)(\text{mm})$$

where w is a thickness (mm) of the sealing portion and $w \geqq t1 \geqq 4.4$ (mm).

10. The method according to claim 7, wherein D is 410 mm, a center thickness of the panel is 10.0 mm, the sealing surface thickness is 7.5 mm, and a body portion center thickness is 4.4 mm.

11. The method according to claim 7, wherein D is 460 mm, a center thickness of the panel is 11.0 mm, the sealing surface thickness is 8.0 mm, and a body portion center thickness is 4.4 mm.

12. The method according to claim 7, wherein D is 510 mm, a center thickness of the panel is 12.0 mm, the sealing surface thickness is 8.5 mm, and a body portion center thickness is 4.8 mm.

13. A cathode ray tube comprising:

a panel having a face surface whose outer shape is a substantial rectangle and a skirt portion which extends substantially vertically from all areas of an outer peripheral portion of the face surface to the face surface, the face surface having an almost flat shape;

a funnel which has a funnel shape whose outer shape of a wide set open portion of the funnel shape has a same outer shape as the skirt portion of the panel; and a sealing portion for connecting the panel and the funnel, wherein the funnel comprises a body portion having a sealing surface which is connected to the sealing portion, a yoke portion connected to the body portion, wherein a wall thickness of the yoke portion is substantially uniform, and a neck portion connected to the yoke portion, and wherein the cathode ray tube includes a portion whose thickness becomes $$(2.78+0.0038\times D) \leqq t1 \leqq (3.7+0.0038\times D)(\text{mm}),$$

where D is a diagonal axis length (mm) between rectangular corner portions of an effective screen of the panel, and t1 is a thickness (mm) at positions which occupy 75% of a length of the body portion extending from the sealing surface of the body portion to the yoke portion along a tube axis direction.

* * * * *